United States Patent [19]

Scheurecker et al.

[11] 4,432,407

[45] Feb. 21, 1984

[54] ARRANGEMENT AT A SUPPORTING AND GUIDING STRUCTURE TO BE USED IN A CONTINUOUS CASTING PLANT

[75] Inventors: Werner Scheurecker; Herbert Spanner, both of Linz, Austria

[73] Assignee: Voest-Alpine Aktiengesellschaft, Linz, Austria

[21] Appl. No.: 511,442

[22] Filed: Jul. 6, 1983

Related U.S. Application Data

[63] Continuation of Ser. No. 205,468, Nov. 10, 1980, abandoned.

[30] Foreign Application Priority Data

Nov. 28, 1979 [AT] Austria ..... 7523/79

[51] Int. Cl.[3] ..... B22D 11/12

[52] U.S. Cl. ..... 164/448; 164/442

[58] Field of Search ..... 164/442, 448; 193/35 TE, 35 R; 226/189, 190, 194

[56] References Cited

U.S. PATENT DOCUMENTS 4,007,822 2/1977 Scheurecker ..... 164/448

FOREIGN PATENT DOCUMENTS 1963146 6/1971 Fed. Rep. of Germany ..... 164/448

*Primary Examiner*—Gus T. Hampilos
*Assistant Examiner*—Jerold L. Johnson
*Attorney, Agent, or Firm*—Brumbaugh, Graves, Donohue & Raymond

[57] ABSTRACT

In a supporting and guiding structure for a continuous casting plant, roller ways supporting the strand on two opposite sides are provided, one of the two roller ways being arranged on a first supporting framework and the other roller way being arranged on the second supporting framework which is braceable relative to the first supporting framework by drawing anchors and is connectable with the first supporting framework and detachable therefrom. In order to be able to effect the connection and release by parts that are easy to handle, a bayonet connection is provided as the connection between supporting framework and drawing anchors. The bayonet connection includes a disc having at least one recess and arranged on the supporting framework. A drawing-anchor head including a lateral neck that corresponds to this recess is insertable into the recess, and the drawing-anchor head or the disc is rotatable into a fastening position axially fixing the drawing anchor.

6 Claims, 4 Drawing Figures

ARRANGEMENT AT A SUPPORTING AND GUIDING STRUCTURE TO BE USED IN A CONTINUOUS CASTING PLANT

This application is a continuation of application Ser. No. 205,468, filed on Nov. 10, 1980 now abandoned.

BACKGROUND OF THE INVENTION

The invention relates to an arrangement at a supporting and guiding structure for a continuous casting plant, in particular for a steel-slab continuous casting plant, comprising roller ways supporting the strand on two opposite sides, one of the roller ways being arranged at a first supporting framework and the other roller way being arranged at a second supporting framework which is braceable relative to the first supporting framework by means of drawing anchors and is connectable with, and detachable from, the first supporting framework.

It is known (U.S. Pat. No. 4,046,188) to fix the drawing anchors that serve for connecting the two supporting frameworks to the supporting frameworks by means of wedges or inserts. Such a wedge or such an insert has a mass of more than 50 kg and is therefore difficult to handle. Inserts must each be secured by a securing pin which penetrates bores of the supporting framework and a bore of the insert. Due to the high weight of the insert, it is difficult to direct these bores to be exactly in alignment with one another, so that the application of the securing pin further complicates the mounting of the supporting and guiding structure.

The invention aims at avoiding these difficulties and has as its object to provide an arrangement of the initially defined kind at a supporting and guiding structure, which makes possible an easy connection and detachment of the drawing anchors with or from the supporting framework, wherein only such parts which are easy to handle are to be manipulated for effecting and undoing the connection.

SUMMARY OF THE INVENTION

These objects are achieved according to the invention in that a bayonet connection is provided as the connection between the supporting framework and each of the drawing anchors, in which a disc is arranged on the supporting framework, which disc comprises at least one recess into which a drawing-anchor head including a lateral nose corresponding to this recess is insertable, the drawing-anchor head or the disc being rotatable into a fastening position axially fixing the drawing anchor.

According to a preferred embodiment, the discs are rotatable, and each is inserted into a cavity of the supporting framework, which cavity is closeable towards the outside by a cover plate.

Advantageously, bores are provided about the circumferences of the discs into which an actuation lever, or a locking pin arranged on the cover plate, is insertable.

Suitably, the discs of the bayonet connection are provided on the first supporting framework of a supporting and guiding structure in which adjustment drives for adjusting the second supporting framework relative to the first supporting framework are connected with the second supporting framework on the one hand and with the drawing anchors on the other hand in a manner that the drawing anchors are detachably fastened to the first supporting framework and, after releasing the connecting means, are removable from the first supporting framework out of the position connecting the supporting frameworks by means of the adjustment drives and retractable into the second supporting framework into a retracted position. In this embodiment, a separation of the first supporting framework from the second one is possible in a particularly simple and quick manner.

BRIEF DESCRIPTION OF THE DRAWINGS

The invention will now be explained in more detail with reference to the accompanying drawings, wherein.

DESCRIPTION OF EXEMPLARY EMBODIMENT

Figure 1:
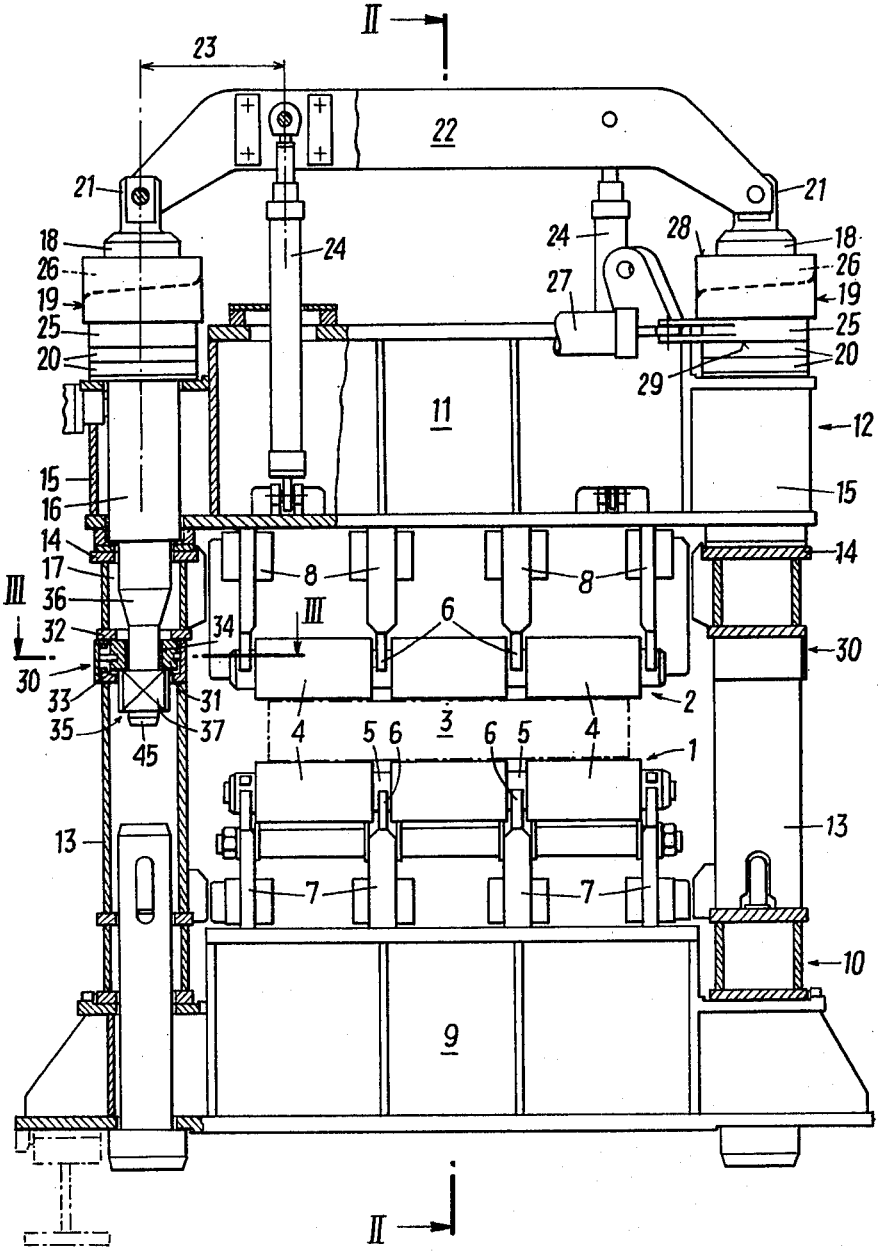
FIG. 1 is a partly sectioned view of a supporting and guiding structure in the direction of the longitudinal axis of the strand.

Between roller ways 1 and 2, a strand 3 is supported and guided. The rollers 4 of each of the roller ways are inserted in bearing brackets 6 by holding means 5, which bearing brackets are fastened to longitudinal beams 7, 8. In order to prevent too intense a bulging of the long and relatively thin rollers 4, four holding means 5, are in the embodiment illustrated, are uniformly distributed over the longitudinal extension of the rollers. The longitudinal beams 7 of the lower roller way are fastened to cross beams 9 and form a first supporting framework 10 together with the cross beams. The longitudinal beams 8 of the upper roller way are also mounted on cross beams 11, forming a second supporting framework 12 together with the same. On the cross beams 9 of the first supporting framework 10, hollow struts 13 are rigidly fastened laterally of the ends of the rollers 4, which struts include a flange 14 on their upper ends. On this flange, one end 15 of a cross beam 11 of the second supporting framework 12 each rests, either directly (with a minimum distance of the roller ways) or with shims interposed (with a distance between the roller ways exceeding the minimum distance, FIG. 1). The cross beams 11 of the second supporting framework 12 are penetrated by drawing anchors 16 on both ends 15, which drawing anchors are in alignment with the cavities 17 of the hollow struts 13 and can be inserted into the cavities.

The ends of the drawing anchors 16 projecting beyond the cross beams of the second supporting framework are each provided with a collar 18. This collar leans against an end 15 of the cross beam 11 of the second supporting framework 12 via a relieving device 19, either directly or with shims 20 interposed therebetween.

Above the collar 18 of each drawing anchor 16 a beam 22 is hinged to an extension 21 of the drawing anchor, one beam each connecting two drawing anchors 16 provided on the ends 15 of one cross beam 11 each. At a slight distance 23 from each of the drawing anchors 16, a pressure medium cylinder 24 arranged approximatey parallel thereto is provided, which is hinged to the beam 22 on the one hand and to the cross beam 11 of the second supporting framework on the other hand. The pressure medium cylinders 24 (also any other adjustment means could be provided instead, for instance a rotatable spindle or the like) each are located between the drawing anchors 16.

The relieving device 19 is comprised of two bushings 25, 26 forming a thread by screw-shaped sliding surfaces that correspond to each other. One of the bushings 25, 26 is rotatable relative to the other bushing, i.e. with the help of a pressure medium cylinder 27 provided on one of the two bushings arranged on oppositely provided drawing anchors 16, whereby the distance of the outer resting surfaces 28, 29 of the bushings 25, 26 between the cross beam 11 and the collar 18 of the respective drawing anchor 16 may be changed. By means of these bushings 25, 26 it is thus possible to brace a cross beam 11 of the second supporting framework 12 against the struts 13 and thus against the first supporting framework 10 with the drawing anchors being fixed in the first supporting framework, or to detach the two supporting frameworks 10, 12 from each other.

Figure 3:
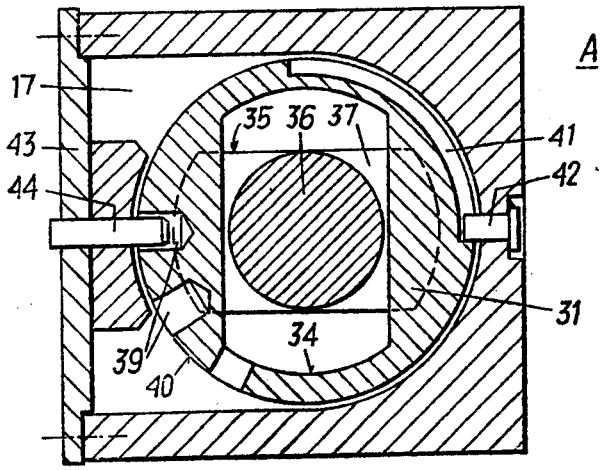
FIGS. 3 and 4 show a detail in section of FIG. 1 on an enlarged scale, the section being carried out along line III—III of FIG. 1.
Figure 4:
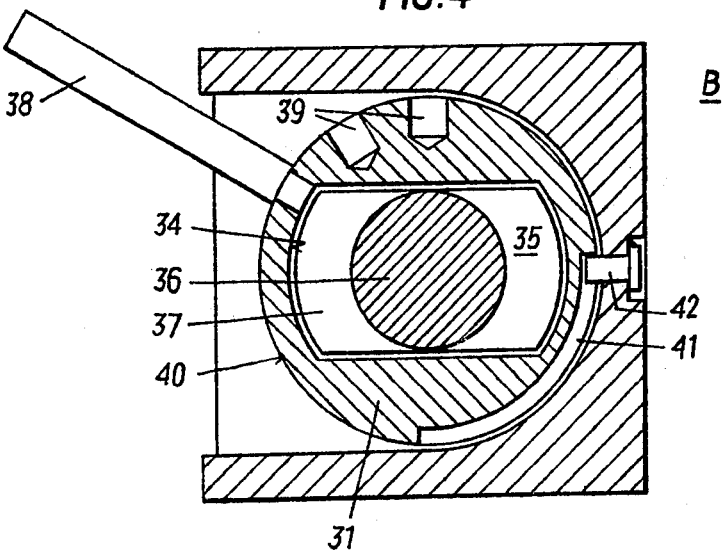

The fixation of the drawing anchors 16 on the struts 13 is effected by means of a bayonet connection 30, which is designed as follows: Into each of the cavities 17 of the struts 13, a disc 31 is rotatably inserted. The cavity is delimited upwardly and downwardly by one plate 32, 33 each. The disc 31 has an oval, centrically arranged recess 34 through which the drawing-anchor head 35, which is designed as a hammer-head-like neck 37 arranged on the tapering end 36 of the drawing anchor 16, can be moved (FIG. 3). The disc 31 can be rotated by means of an actuation lever 38 illustrated in FIG. 4, which is insertable into bores 39 arranged about the circumference 40 of the disc 31. As a rotation stop, a pin 42 projecting into a peripheral groove 41 of the disc 31 is provided, mounted on the strut 13. The cavity 17 in which the disc 31 is inserted is closed towards the outside by means of a removable cover plate 43. On this cover plate 43 a locking pin 44 projecting into the cavity 17 is fastened, which, with the cover plate 43 mounted on the strut 13, projects into one of the bores 39 of the disc 31. The cavity 17 accommodating the disc 31 suitably is filled with grease.

The arrangement functions in the following manner: If the second supporting framework 12 is to be lifted off the first supporting framework 10, the relieving devices 19 will be actuated first, i.e., the bracing of the supporting frameworks will be released, whereupon, after removing the cover plates 43, the actuation lever 38 is inserted into one of the bores 39 of the discs 31 and the discs are rotated from the fastening position A illustrated in FIG. 3 into the release position B illustrated in FIG. 4. Since a pivoting of the actuation lever 38 by 90° is not possible, the actuation lever 38 has to be stuck into the bores 39 of the discs 31 consecutively in order to be able to effect a rotation of the discs 31 by 90°. In the release position B, the oval recess 34 of each disc 31 is in alignment with the hammer-head-like neck 37 of the drawing anchor 16 so that it is possible to pull back the drawing anchors into the second supporting framework 12 by actuating the pressure medium cylinders 24. Then, the second supporting framework 12 can be lifted off the first supporting framework 10 with the help of a hall crane.

With the help of the drawing anchors 16, it is also possible to keep the rollers 4 of the outer and inner roller ways 1, 2 at a great distance from each other. This is effected in the following way: At first, the bracing of the supporting frameworks 10, 12 is released by actuating the relieving devices 19. Afterwards, the cover plates 43 are removed and the discs 31 are rotated into the release position B with the help of the actuation lever 38. With the help of the pressure medium cylinders 24, the drawing anchors 16 are pulled back until the hammer-head-like necks 37 come to be above the disc 31. Now, after turning the discs 31 back into the fastening position A, the drawing anchors 16 are again lowered until they rest upon the discs 31. Subsequently, after removing the shims 20, the cross beams 11 can be further lifted with the help of the pressure medium cylinders 24. A projection 45 below the hammer-head-like neck 37 each serves for centering the drawing anchors 16 in this lifted position; it is, moreover, of advantage when introducing the drawing anchors into the struts 13.

For detaching the fastening of the drawing anchors from the first supporting framework, it is merely necessary to demount the cover plates 43 and to manipulate an actuation lever 38. Both parts, cover plate and actuation lever, may be designed to be very light so that the work in connection with the release and the fastening of the drawing anchors at the first supporting framework is easily feasible.

The invention is not limited to the embodiment illustrated in the drawings, but may be modified in various aspects. Thus, it is possible to arrange the discs 31 ridigly in the struts 13 and to mount the drawing-anchor head 35 so as to be rotatable. Furthermore, the hammer-head-like neck of the drawing anchor as well as the corresponding recess in the disc may be designed in alternative shapes, the only thing to be ensured being that the drawing-anchor head contacts part of the disc from behind and that it is large enough to accommodate the tensile forces occurring.

Figure 2:
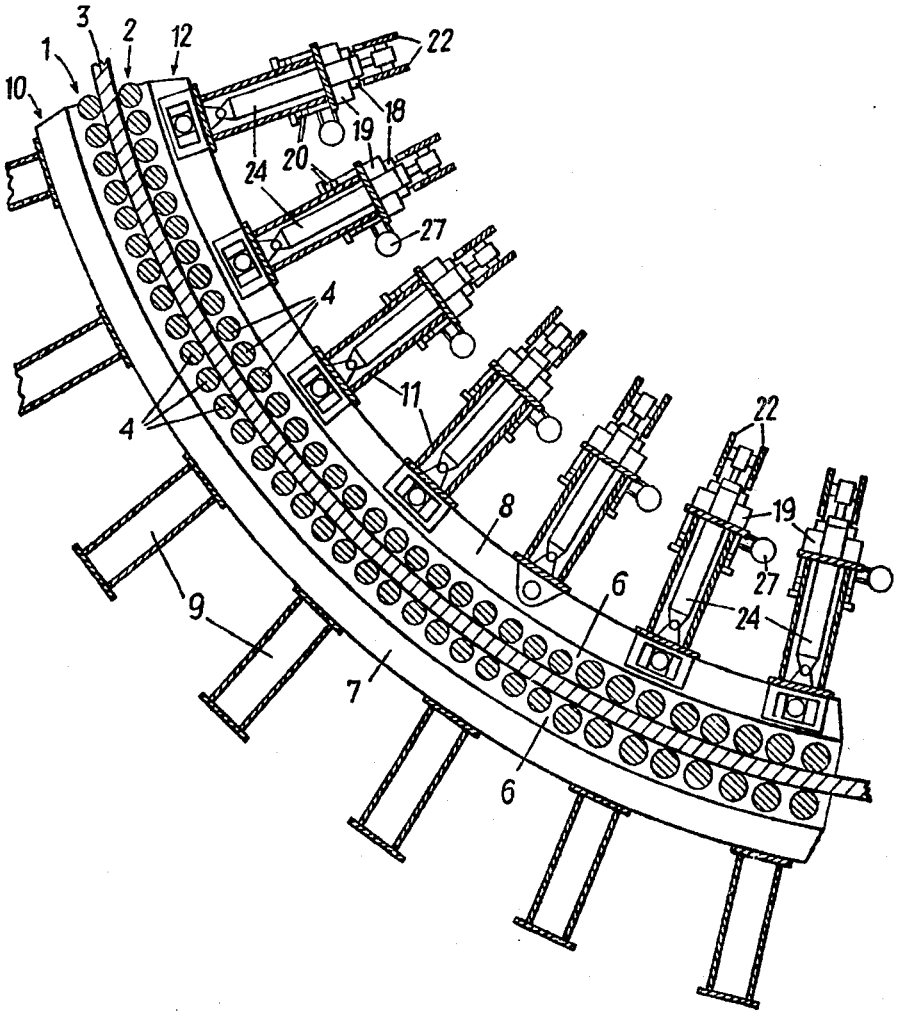
FIG. 2 illustrates a section along line II—II of FIG. 1 on a reduced scale.

The arrangement according to the invention is applicable in an advantageous manner not only with a supporting and guiding structure including a plurality of drawing anchors, as is illustrated in FIG. 2, but it may also be provided in a supporting and guiding structure which comprises only four drawing anchors arranged at the corners of the same, for instance in a straightening aggregate.

What we claim is:

1. In an arrangement at a supporting and guiding structure to be used in a continuous casting plant for casting a strand, in particular a continuous casting plant for casting steel slabs, and of the type including oppositely arranged roller ways for supporting the strand on two opposite sides thereof, a first supporting framework and a second supporting framework for accommodating said roller ways, and drawing anchors for bracing said second supporting framework relative to said first supporting framework, said second supporting framework being connectable with, and detachable from, said first supporting framework, the improvement which is characterized in that a bayonet connection is provided as connecting means for connecting each of said drawing anchors with one of said first and said second supporting framework, said bayonet connection including a disc, arranged in a cavity provided in one of said first and said second supporting frameworks, and having at least one recess defined therein, each one of said drawing anchors comprises a drawing-anchor head with a lateral neck corresponding to said at least one recess, said drawing-anchor head being insertable into said at least one recess, and said drawing-anchor head is rotatable between a fastening position axially fixing the pertaining one of said drawing anchors, and a releasing position whereby said drawing anchor can be withdrawn from one of said first and said second supporting frameworks, thereby enabling the other of said first and said second supporting frameworks to be detached from said one framework.

2. In an arrangement at a supporting and guiding structure to be used in a continuous casting plant for casting a strand, in particular a continuous casting plant for casting steel slabs, and of the type including oppositely arranged roller ways for supporting the strand on two opposite sides thereof, a first supporting framework and a second supporting framework for accommodating said roller ways, and drawing anchors for bracing said second supporting framework relative to said first supporting framework, said second supporting framework being connectable with, and detachable from, said first supporting framework, the improvement which is characterized in that a bayonet connection is provided as connecting means for connecting each of said drawing anchors with one of said first and said second supporting framework, said bayonet connection including a disc, arranged in a cavity provided in one of said first and said second supporting frameworks, and having at least one recess defined therein, each one of said drawing anchors comprises a drawing-anchor head with a lateral neck corresponding to said at least one reces, said drawing-anchor head being insertable into said at least one recess, and said disc is rotatable between a fastening position axially fixing the pertaining one of said drawing anchors, and a releasing position whereby said drawing anchor can be withdrawn from one of said first and said second supporting frameworks, thereby enabling the other of said first and said second supporting frameworks to be detached from said one framework.

3. An arrangement as set forth in claim 2, further comprising a cover plate for closing toward the outside said cavity provided in said one of said first and said second supporting frameworks.

4. An arrangement as set forth in claim 3, further comprising wall portions defining bores provided about the circumference of said disc, and an actuation lever insertable into said bores.

5. An arrangement as set forth in claim 3, further comprising wall portions defining bores provided about the circumference of said disc, and a locking pin arranged on said cover plate, said locking pin being insertable into said bores.

6. An arrangement as set forth in claim 1, 2, 3, 4, or 5, wherein said supporting and guiding structure includes adjustment drives for adjusting said second supporting framework relative to said first supporting framework, and wherein said disc of said bayonet connection is provided on said first supporting framework and said adjustment drives are connected with said second supporting framework on the one hand and with said drawing anchors on the other hand in such a manner that said drawing anchors are detachably fastened to said first supporting framework and, after releasing said connecting means, are removable from said first supporting framework out of a position connecting said first and said second supporting framework by said adjustment drives and are retractable into said second supporting framework into a retracted position.

* * * * *

UNITED STATES PATENT AND TRADEMARK OFFICE

CERTIFICATE OF CORRECTION

PATENT NO. : 4,432,407

DATED : Feb. 21, 1984

INVENTOR(S) : Scheurecker et al.

It is certified that error appears in the above—identified patent and that said Letters Patent is hereby corrected as shown below:

First page, following last line of first column, insert:

| | | |
|---|---|---|
| --4,046,188 | 9/1977 | Kagerhuber et al. |
| 4,058,154 | 11/1977 | Streubel et al. |
| 4,074,746 | 2/1978 | Scheurecker et al. |
| 4,146,083 | 3/1979 | Scheurecker et al.--. |

Col. 2, line 31, after "5," delete "are".

Col. 4, line 27, "ridigly" should read --rigidly--.

Signed and Sealed this

Twenty-ninth Day of May 1984

[SEAL]

Attest:

GERALD J. MOSSINGHOFF

Attesting Officer

Commissioner of Patents and Trademarks